175-48 SR
12/20/77 XR 4,063,602

United States Patent [19]
Howell et al.
[11] 4,063,602
[45] Dec. 20, 1977

[54] DRILLING FLUID DIVERTER SYSTEM

[75] Inventors: James Damron Howell, Gretna, La.; Robert William Beck, George Hayden Bruce, John David McLain, all of Houston, Tex.

[73] Assignee: Exxon Production Research Company, Houston, Tex.

[21] Appl. No.: 737,751

[22] Filed: Nov. 1, 1976

Related U.S. Application Data

[63] Continuation-in-part of Ser. No. 604,388, Aug. 13, 1975, abandoned.

[51] Int. Cl.[2] ..... E21B 7/12
[52] U.S. Cl. ..... 175/7; 175/48
[58] Field of Search ..... 175/5, 7, 38, 48, 50, 175/72; 166/.5; 73/155

[56] References Cited

U.S. PATENT DOCUMENTS

| | | | |
|---|---|---|---|
| 3,137,348 | 6/1964 | Ahlstone et al. | 175/7 X |
| 3,179,179 | 4/1965 | Kohfahl | 166/.5 |
| 3,189,100 | 6/1965 | Haeber et al. | 166/.5 |
| 3,237,694 | 3/1966 | Leake | 166/.5 |
| 3,809,170 | 5/1974 | Ilfrey et al. | 175/48 X |
| 3,811,322 | 5/1974 | Swenson | 175/48 X |
| 3,885,623 | 5/1975 | Watkins et al. | 166/.5 |
| 3,910,110 | 10/1975 | Jefferies et al. | 73/155 |
| 3,911,740 | 10/1975 | Calhoun | 175/48 |
| 3,917,008 | 11/1975 | Suter | 175/38 |

*Primary Examiner*—Ernest R. Purser
*Assistant Examiner*—Richard E. Favreau
*Attorney, Agent, or Firm*—Salvatore J. Casamassima

[57] ABSTRACT

An improved method and apparatus for offshore drilling is described which is particularly useful for drilling in deep water from a floating surface vessel. Drilling fluid is introduced into a drill string extending from the vessel into a wellbore in the floor of the body of water. In order to maintain a controlled hydrostatic pressure within the riser, drilling fluids are diverted from the lower end of the riser and are either discharged into the body of water or pumped to the surface through a return conduit adjacent the riser.

19 Claims, 1 Drawing Figure

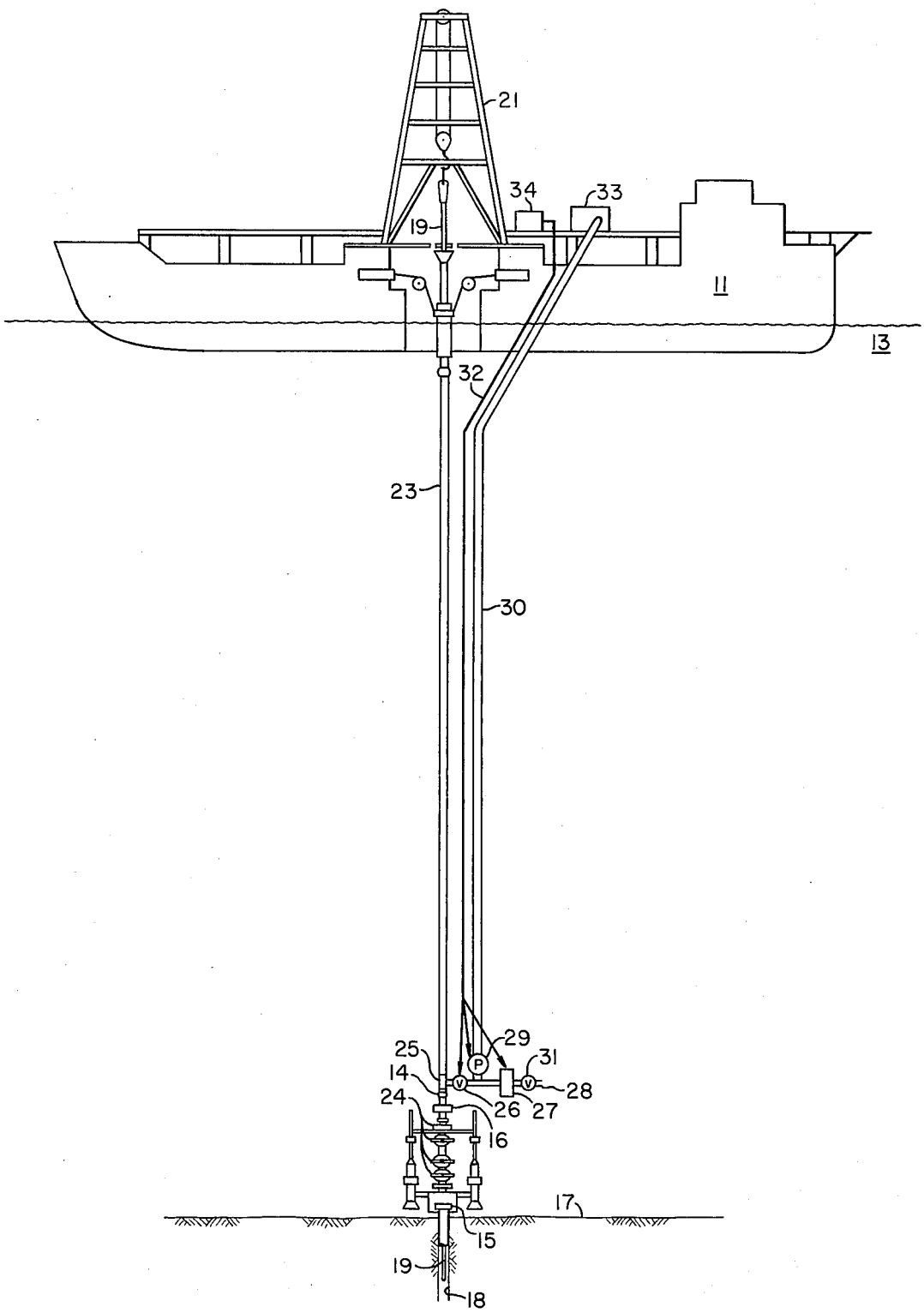
21
34
33
19
11
13
32
23
30
29
25
31
14
28
24
26
27
16
17
15
19
18

DRILLING FLUID DIVERTER SYSTEM

CROSS REFERENCE TO RELATED APPLICATIONS

This application is a continuation-in-part of application Ser. No. 604,388 filed Aug. 13, 1975, now abandoned.

BACKGROUND OF THE INVENTION

1. Field of the Invention

This invention relates to an improved method and apparatus for drilling a well from a floating vessel. More particularly, the invention relates to a method and apparatus for maintaining a controlled hydrostatic pressure in a drilling riser.

2. Description of the Prior Art

In recent years the search for offshore deposits of crude oil and natural gas has been extended into deep waters overlying continental shelves. With increased water depths, the conduct of drilling operations from floating vessels has become more prevalent since economic considerations militate against the use of bottom-founded drilling platforms commonly used in shallow water. The drill rig and associated equipment are positioned aboard a floating vessel which is stationed over the wellsite. The drill string extends from the vessel to the bottom of the well through a wellhead on the floor of the body of water. A separate return conduit, normally a riser pipe, is positioned between the wellhead and the vessel to return the drilling fluid to the vessel.

Well control is an important aspect of any drilling operation. Conventionally, well control is established by maintaining the density of the drilling fluid and thus the hydrostatic pressure exerted on the subsurface formations at a level sufficient to overcome formation pressures and to prevent the influx of fluid from the formation. If uncontrolled, influx of formation fluids can lead to a blowout and fire, frequently causing loss of life, damage to property, and pollution of the seaway.

At the same time, caution is necessary to assure that the density and resulting pressure gradient of the column of drilling fluid does not exceed the natural fracture gradient of the formation, i.e., the pressure gradient necessary to initiate and propagate a fracture in the formation. This consideration is especially important in deep waters where the natural fracture gradient of shallow formations does not greatly exceed that of a column of sea water. To minimize the possiblity of formation fracture during the drilling of the surface hole (the first few thousand feet), the hydrostatic head of the drilling fluid should not greatly exceed that of a column of sea water.

In deep water, achieving a hydrostatic head high enough to control the well and yet low enough to prevent fracturing subsurface formations requires careful control of the pressure gradient of the drilling fluid. Where the drilling traverses two different formations having different pressures, it is possible that the hydrostatic pressure of the drilling fluids in the return column from the drill bit can become great enough to enter into one formation (a condition known as "lost circulation"). With lost circulation, the hydrostatic pressure of the drilling fluid can decrease below the pressure of the other formation and cause a blowout.

If the mud returns are conducted to the ship through the riser, the pressure of the mud which acts on the formation is a function of the density of the mud returns. When drilling shallow formations the drill cuttings can cause a sufficient mud density increase to cause formation fracture. Previously proposed solutions for this problem have involved decreasing the density of the drilling returns, either by decreasing the rate of penetration, increasing the circulation rate of the input fluid, or injecting gas into the riser. Each approach is subject to certain difficulties. Decreasing the penetration rate requires additional rig time with the attendant expense. Increasing the circulation rate frequently requires extra pumps and may lead to erosion of the borehole. Gas injection requires assembly and deployment of additional complex and expensive equipment at the well site.

SUMMARY OF THE INVENTION

The present invention permits control of the hydrostatic pressure of drilling fluid during drilling operations from a floating vessel. Pressure control is achieved without reducing penetration rate, increasing circulation rate, or using gas injection. In the present invention, drilling fluid returns are diverted from the riser pipe so as to control the level of the drilling fluid in the riser pipe and, therefore, the hydrostatic pressure of the fluid.

Diversion of the drilling fluid from the riser pipe can be accomplished by selectively discharging the drilling fluid from the riser pipe into the body of water or by pumping the drilling fluid from the riser pipe back to the surface through a conduit external to the riser. In either case drilling fluid will be withdrawn from the riser pipe in controlled amounts to permit pressure control within the riser pipe.

Controlled discharge of drilling fluid from the riser pipe is achieved by the use of a surface controllable valve which selectively opens and closes or meters flow through an outlet located near the bottom of the riser. The rate of fluid flow through the valve may be measured and a signal indicative thereof generated and transmitted to the surface. Adjustments in the discharge of the drilling fluid may then be made in accordance with the signal received so as to maintain hydrostatic pressure within allowable limits.

In the event that it is undesirable to discharge the drilling fluid on the ocean floor, either for economic or environmental reasons, the drilling fluid can be diverted from the riser by the use of a controlled pump system. A pump positioned near the bottom of the riser withdraws drilling fluid from an outlet of the riser pipe and returns it to the drilling vessel through a conduit. The pump discharge rate is controlled in response to a control system which monitors changes in conditions such as lost circulation or well flow.

It will therefore be apparent that the present invention will permit a substantial reduction in the hydrostatic pressure exerted by drilling fluids while drilling without any substantial reduction in drilling rate, increase in circulation rate, or injection of gas. The present invention thus permits control of pressurized formations during normal drilling operations while reducing the danger of exceeding their fracture gradients and offers significant advantages over systems existing heretofore.

BRIEF DESCRIPTION OF THE DRAWING

The drawing is a schematic diagram of a preferred embodiment of apparatus useful in practicing the invention.

DESCRIPTION OF THE PREFERRED EMBODIMENT

The drawing shows a drilling vessel 11 floating on a body of water 13 and equipped to carry out the methods of the present invention. A wellhead 15 is positioned on the floor 17 of the body of water. A drill string 19 is suspended from derrick 21 mounted on the vessel and extends to the bottom of the wellbore 18. The tubular drill string 19 is concentrically received within a tubular riser 23 positioned between the upper end of the blowout preventer stack 24 and the vessel 11. The drill string 19 is rotated within the riser. Drilling fluid is pumped down through the center of the drill string to the drilling bit (not shown) at the bottom of the wellbore and is returned to the riser 23 through the annulus between the drill string 19 and the wellbore 18.

In the riser 23 is a special tubular joint 25 which may preferably be disposed immediately above the lower ball joint 14, as shown. Joint 25 has a lateral outlet provided with a control valve 26. When valve 26 is open it permits fluid to flow from the riser through flowmeter 27 and check valve 31 and out through outlet 28 to the sea. Flowmeter 27 is conventional and is located downstream of valve 26. Flowmeter 27 continuously measures the rate at which drilling fluid is being discharged through outlet 28. A single armor-covered umbilical 32 supplies power and control from the drilling vessel to valve 26. Data may also be transmitted back to the vessel via umbilical 32 as an electrical signal which is recorded in a well-known manner as a function of time. Control, power, and data signals are received and transmitted between the vessel and the underwater unit at control panel 34. The controls can be utilized to monitor changes which indicate flow of formation fluids into the wellbore or loss of wellbore fluids into the earth formations.

Flow from riser 23 can either be discharged through outlet 28 to the sea or returned to drilling vessel 11. Subsea pump 29 is shown connected to the flow line which extends from valve 26 and is connected to a power source (not shown) via umbilical 32. If it is desirable or necessary to return drilling fluids to the surface, pump 29 is activated and fluids exiting from valve 26 will be withdrawn and pumped through flow conduit 30 to the vessel and into tank 33 which is adapted to condition the returning drilling fluids for recirculation into the wellbore. Check valve 31 prevents the entry of sea water during pumping. If drilling fluids are discharged into the sea then pump 29 is not used and all fluids flow directly through outlet 28.

This system is particularly useful in the drilling of underwater formations having insufficient fracture strength to withstand the hydrostatic pressure developed when drilling fluid is returned to the surface through a marine riser. With the special riser joint 25 in position, drilling is started and the drilling fluid from the drilling bit returns to valve 26 through the annulus between drill string 19 and the earth formations. Valve 26 can be a conventional control valve which opens upon receiving a command signal from the vessel conveyed through umbilical 32. Opening the valve will cause all drilling fluids to be diverted from the bottom of riser 23. Valve 26 may preferably be designed to close automatically in the event of a power failure. Valve 26 may also be capable of regulating the rate of flow as a function of the signal received via umbilical 32.

In the initial phases of drilling where sea water will probably be used as a drilling fluid, it may be preferable to discharge drilling fluid into the sea. The normal procedure would be to keep valve 26 open so that the pressure within the riser adjacent joint 25 will equalize with the pressure of the sea at outlet 28. However, utilizing control panel 34, it may be preferable to regulate or meter flow through valve 26 or to alternately open and close valve 26 so as to maintain the hydrostatic pressure of the drilling fluid in a range which will not fracture the formation yet which will be adequate to prevent well control loss.

In drilling at slightly greater depths it may be desirable to utilize weighted or chemically treated drilling fluids. Such fluids are normally expensive and there is an economic incentive to return the fluids to the surface for conditioning and reuse. However, even in instances where the treated drilling fluid is inexpensive it may be desirable or necessary to return the drilling fluids to the surface to prevent contamination or pollution of the seaway. There may even be instances where it would be necessary to recirculate a sea water drilling fluid so as to prevent the discharge of drilled solids into the sea.

As with the discharge system, the pump system can be controlled to maintain hydrostatic pressure in the riser within a certain preferred range. The pump discharge rate can be measured and controlled from the surface to maintain pressure at the bottom of the riser approximately constant and equal to the pressure of the sea water at that point. In the event lost circulation or a flow of formation fluids into the wellbore occurs, control signals directed from control panel 34 can change the discharge rate of the pump to maintain a desired hydrostatic pressure at the bottom of the riser.

Should a well flow occur, a rapid increase in hydrostatic pressure can be obtained by stopping pump 29 (if it is in operation) and by closing valve 26. Closing the diverter system will cause the level of drilling fluid to rise inside the marine riser thereby increasing hydrostatic pressure against the formation and restoring well control. After surface or other casing is cemented to protect shallow low pressure zones, valve 26 can be closed to permit return of the drilling fluid to the vessel via riser 23.

As will be apparent, additional outlets and control valves (not shown) and subsea pumps (not shown) can be utilized along the length of the riser to discharge drilling fluid at various sea levels. The pressure exerted on the wellbore by the drilling fluid returns can then be varied by selectively opening and closing the valves or altering the pump discharge rate to vary the height of the column of drilling fluid above the floor of the body of water.

While particular embodiments of the present invention have been shown and described, it is apparent that changes and modifications may be made without departing from this invention and are intended to be embraced within the spirit and scope of this invention.

We claim:

1. In a method of drilling a well in a subterranean formation beneath a body of water from a surface vessel wherein a drill string passes through a riser pipe which extends from said vessel to a subsea wellhead and then through a borehole under the body of water and wherein a drilling fluid is introduced into said drill string and is returned first through the annulus between said drill string and said borehole and then into the annulus between said drill string and said riser pipe, the improvement comprising:

a. monitoring the pressure within said riser pipe;
b. opening a surface controllable valve positioned near the bottom of said riser pipe to selectively divert the returning drilling fluid from said riser pipe whenever the pressure within said riser pipe exceeds said controlled hydrostatic pressure; and
c. closing said valve whenever the pressure within said riser pipe is below said controlled hydrostatic pressure.

2. The method of claim 1 wherein sufficient amounts of said drilling fluid are diverted from said riser so that the hydrostatic pressure within said riser pipe is below the pressure necessary to fracture said formation.

3. The method of claim 1 wherein said drilling fluid is discharged into said body of water after it is diverted from said riser pipe.

4. The method of claim 3 wherein said drilling fluid is discharged into said body of water at a rate which is sufficient to maintain the hydrostatic pressure within said riser pipe below the pressure necessary to fracture said formation.

5. The method of claim 1 wherein said drilling fluid is pumped to said surface vessel after it is diverted from said riser pipe.

6. The method of claim 5 wherein said drilling fluid is pumped to said surface vessel at a rate which is sufficient to maintain the hydrostatic pressure within said riser pipe below the pressure necessary to fracture said formation.

7. In a method of drilling a well in a subterranean formation beneath a body of water from a surface vessel wherein a drill string passes through a riser pipe which extends from said vessel to a subsea wellhead and then through a borehole under the body of water and wherein a drilling fluid is introduced into said drill string and is returned first through the annulus between said drill string and said borehole and then into the annulus between said drill string and said riser pipe, the improvement comprising:

a. monitoring the pressure within said riser pipe;
b. opening a surface controllable valve positioned near the bottom of said riser pipe to selectively discharge the returning drilling fluid from said riser pipe into said body of water;
c. measuring the rate of discharge of said drilling fluid into the body of water;
d. generating a surface detectable signal indicative of the measured rate of discharge;
e. controlling the rate of discharge through said valve so as to maintain the hydrostatic pressure within said riser pipe below the pressure necessary to fracture said formation; and
f. closing said valve whenever necessary to maintain the hydrostatic pressure within said pipe at a level sufficient to prevent the influx of formation fluids into the borehole.

8. The method of claim 7 wherein said signal is an electrical signal.

9. In a method of drilling a well in a subterranean formation beneath a body of water from a surface vessel wherein a drill string passes through a riser pipe which extends from said vessel to a subsea wellhead and then through a borehole under the body of water and wherein a drilling fluid is introduced into said drill string and is returned first through the annulus between said drill string and said riser pipe, the improvement comprising:

a. monitoring the pressure within said riser pipe;
b. opening a surface controllable valve positioned near the bottom of said riser pipe to selectively withdraw the returning drilling fluid from said riser pipe;
c. pumping said withdrawn drilling fluid to said surface vessel;
d. measuring the rate at which said drilling fluid is pumped;
e. generating a surface detectable signal indicative of the measured pumping rate;
f. controlling the pumping rate so as to maintain the hydrostatic pressure within said riser pipe below the pressure necessary to fracture said formation; and
g. closing said surface controllable valve whenever necessary to maintain the hydrostatic pressure within said pipe at a level sufficient to prevent the influx of formation fluids into the borehole.

10. The method of claim 9 wherein said signal is an electrical signal.

11. In an apparatus for drilling a well through a subterranean formation beneath a body of water from a surface vessel, said apparatus comprising a riser pipe which extends from said vessel to a subsea wellhead and a drill string which passes through said riser pipe and into a borehole under the body of water, the improvement comprising:

surface controlled valve means positioned near the bottom of and in fluid communication with said riser pipe, said valve means permitting diversion of drilling fluid from said riser pipe when said valve means is in an open position so that the hydrostatic pressure in said riser pipe is maintained at a level below the fracture pressure of said formation.

12. Apparatus of claim 11 wherein said valve means is a control valve and wherein the apparatus further includes surface means for controlling the rate of flow through said control valve.

13. Apparatus of claim 11 which further includes means for measuring the rate of fluid flow through said valve means and generating a surface detectable signal indicative thereof.

14. Apparatus of claim 13 wherein said signal indicative of the rate of fluid flow through said valve means is an electrical signal and further including means for transmitting said electrical signal to the surface vessel.

15. Apparatus of claim 11 which further includes means for conveying the drilling fluid diverted from said riser pipe to said surface vessel.

16. Apparatus of claim 15 wherein said conveying means includes a conduit for conveying the drilling fluid from said valve means to said surface vessel and means for pumping said drilling fluid up said conduit.

17. In an apparatus for drilling a well through a subterranean formation beneath a body of water from a surface vessel, said apparatus comprising a riser pipe which extends from said vessel to a subsea wellhead and a drill string which passes through said riser pipe and into a borehole under the body of water, the improvement comprising:

valve means in fluid communication with said riser pipe for selectively diverting drilling fluid from said riser pipe;
a conduit positioned between said valve means and said surface vessel; pumping means for conveying said drilling fluid up said conduit; means for measuring the rate of fluid flow through said valve means and generating a surface detectable signal indicative thereof; and control means responsive to said surface detectable signal for controlling the rate of fluid flow through said valve means to maintain the hydrostatic pressure in said riser pipe at a level below the fracture pressure of said formation.

18. Apparatus of claim 17 wherein said control means includes surface means for controlling said valve means.

19. Apparatus of claim 17 wherein said control means includes surface means for controlling said pumping means.

* * * * *